US005511392A

United States Patent [19]

Sawazaki et al.

[11] Patent Number: 5,511,392

[45] Date of Patent: Apr. 30, 1996

[54] METHOD AND APPARATUS FOR ADJUSTING THE STITCH LENGTH ON A CIRCULAR KNITTING MACHINE

[75] Inventors: Masatoshi Sawazaki, Kobe; Takao Shibata, Osaka; Yoshiaki Igarashi; Kiyoshi Hayashi, both of Kobe; Naganori Ueda, Kashihara, all of Japan

[73] Assignee: Precision Fukuhara Works, Ltd., Japan

[21] Appl. No.: 333,851

[22] Filed: Nov. 3, 1994

[30] Foreign Application Priority Data

Nov. 4, 1993 [JP] Japan ..... 5-301323

[51] Int. Cl.[6] ..... D04B 15/36

[52] U.S. Cl. ..... 66/54; 66/55; 66/27

[58] Field of Search ..... 66/8, 23, 27, 54, 66/55, 59, 146

[56] References Cited

U.S. PATENT DOCUMENTS

| | | | |
|---|---|---|---|
| 1,078,681 | 11/1913 | Houseman . | |
| 2,012,607 | 8/1935 | Houseman | 66/36 |
| 4,331,007 | 5/1982 | Marchisio | 66/55 |
| 4,977,758 | 12/1990 | Muir | 66/27 |
| 5,018,370 | 5/1991 | Tsuchiya et al. | 66/55 |
| 5,174,133 | 12/1992 | Kawase et al. | 66/57 |
| 5,212,967 | 5/1993 | Shibata et al. | 66/55 |
| 5,275,020 | 1/1994 | Scherzinger | 66/27 |
| 5,287,709 | 2/1994 | Seino et al. | 66/55 |

FOREIGN PATENT DOCUMENTS

| | | | |
|---|---|---|---|
| 1490120 | 6/1967 | France . | |
| 2669045 | 5/1992 | France | 66/55 |
| 1008860 | 5/1957 | Germany . | |
| 1289611 | 2/1969 | Germany . | |
| 2012085 | 1/1971 | Germany . | |
| 2631858 | 2/1977 | Germany . | |
| 3232643 | 8/1984 | Germany | 66/55 |
| 861880 | 3/1961 | United Kingdom . | |
| 2156866 | 10/1985 | United Kingdom . | |
| 2170827 | 8/1986 | United Kingdom . | |
| 2193230 | 2/1988 | United Kingdom . | |

*Primary Examiner*—John J. Calvert

*Attorney, Agent, or Firm*—Bell, Seltzer, Park & Gibson

[57] ABSTRACT

A method of and circular knitting machine for producing a knit fabric having more uniform stitches including yarn feeders feeding a plurality of yarns to stitch forming instrumentalities, the spacing of which affects stitch length and which is subject to change during operation of the knitting machine, a sensor for sensing the tension in the plurality of yarns which changes with changes in the spacing of the stitch forming instrumentalities, and generating a signal indicative of the average tension in the yarns, a comparator for comparing the sensor signal with a pre-set desired tension, a convertor for converting the comparison result into a drive signal, and an adjuster adjusting the spacing of the stitch forming instrumentalities responsive to the drive signal.

20 Claims, 8 Drawing Sheets

METHOD AND APPARATUS FOR ADJUSTING THE STITCH LENGTH ON A CIRCULAR KNITTING MACHINE

FIELD OF THE INVENTION

The present invention relates to circular knitting machines and more particularly to such circular knitting machines in which the stitch length in the knit fabric is adjusted responsive to changing conditions.

BACKGROUND OF THE INVENTION

In circular knit fabrics, it is highly desirable to have the stitch loops as uniform as possible. Various changeable conditions substantially affect the stitch loops being formed on a circular knitting machine. Examples of such changeable conditions are the tension in the yarns being fed to the knitting instrumentalities and the spacing between the upper end of the needle cylinder and the sinker cap in a single knit circular knitting machine or the dial in a double-knit circular knitting machine.

Generally, the stitch loops being formed by a circular knitting machine are adjusted by a movable support for the stitch cams which is moved by an eccentric screw or rotating cam. Once the position of the stitch cam support is adjusted, the screw or cam is stopped by a stop means. With such adjustment devices, the movement of the screw or rotation of the cam is conducted artificially by a mechanic or fixer and is not conducted automatically responsive to changing conditions.

Recently, it has been proposed to adjust the stitch cam support by means of a rotary actuator. However, the rotary actuator is too large for a knitting machine having multiple yarn feeding stations.

Further, it has been previously proposed in U.S. Pat. No. 5,018,370 to provide a central stitch length controlling apparatus for a circular knitting in which an elevating means vertically adjusts the stitch cam support ring to vary the length of the stitch loops being formed. However, the elevating means is manually operated and is not responsive to changing conditions.

In all of these prior stitch adjustments, the stitch cam is stopped at a certain position when the stitch adjustment is made. Therefore, variations in the tension in the yarns being fed induced by the inertia of the components of the knitting section and their thermal expansion and contraction are not considered. Consequently, knitting flaws tend to occur, resulting in less fabric quality than is desired and extremely poor productivity.

One prior proposal contained in Japanese Patent Laid Open No. 195386 of 1993 does take dimensional variation of the knitting machine components caused by thermal expansion or contraction into account. This proposal attempts to compensate automatically for variations in the gap between the upper end of the needle cylinder and the periphery of the dial. Compensating structural members are provided as supports for the dial and needle cylinder which thermally expand and contract at the same rate as the knitting components. Such correlation between the rates of thermal expansion and contraction requires that the compensating structural members be machined with very high precision to extremely close tolerances. Such manufacturing procedures are quite costly and difficult.

SUMMARY OF THE INVENTION

With the foregoing in mind, it is an object of the present invention to provide a method and apparatus for adjusting stitch loops being formed by a circular knitting machine having multiple yarn feeding stations automatically responsive to changing conditions that affect such stitch loops.

This object is accomplished in one embodiment of the present invention by providing a tension detecting means for detecting the tension in the knitting yarns being fed to the knitting elements. The tension detecting means generates a signal indicative of the tension detected and transmits that signal to a control means. The control means compares the tension signal to a desired, pre-set value and generates a driving signal based upon the result of that comparison. The driving signal is directed to an elevating means which raises or lowers the stitch cam holder to control the length of the stitches and thusly provide a higher quality knit fabric. In a double knitting machine, dial needle stitch cam support ring adjusting means may be provided to adjust the dial needles responsive to the drive signal to control the length of those stitches.

Alternatively, in a second embodiment, a sensing means for sensing the size of the gap between the upper end of the needle cylinder and the sinker cap or the dial periphery can be provided. The sensing means creates a signal and transmits the same to a control means. The control means compares the signal from the gap sensing means with a pre-set value and generates a drive signal which raises or lowers the dial or cap accordingly.

BRIEF DESCRIPTION OF THE DRAWINGS

Some of the objects and advantages of the present invention having been stated, others will appear as the description proceeds when considered in conjunction with the accompanying schematic drawings, in which.

Detailed Description of the Illustrated Embodiments

Figure 1:
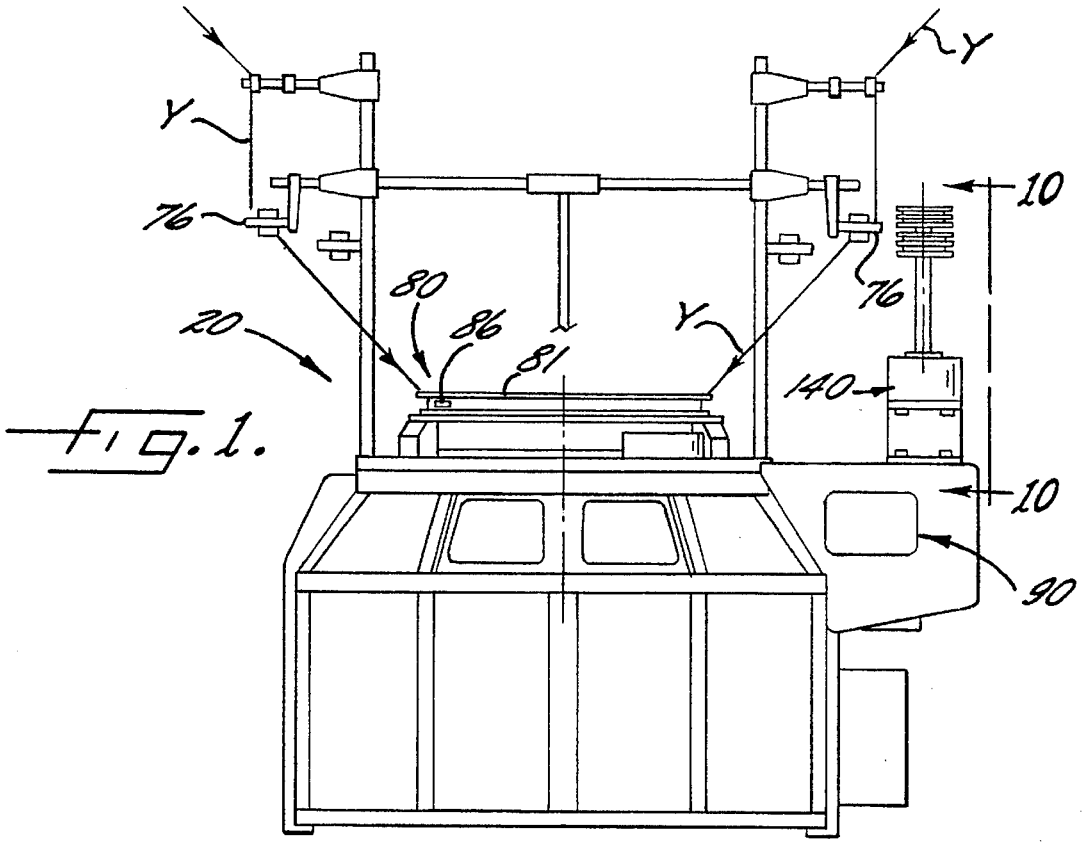
FIG. 1 is an elevational view of a circular knitting machine having multiple yarn feeding stations.

Referring now more specifically to the drawings, there is illustrated in FIG. 1 a circular knitting machine generally indicated at 20. Knitting machine 20 may be either a single knit circular knitting machine or a double knit circular knitting machine 20' in accordance with this invention.

Figure 3:
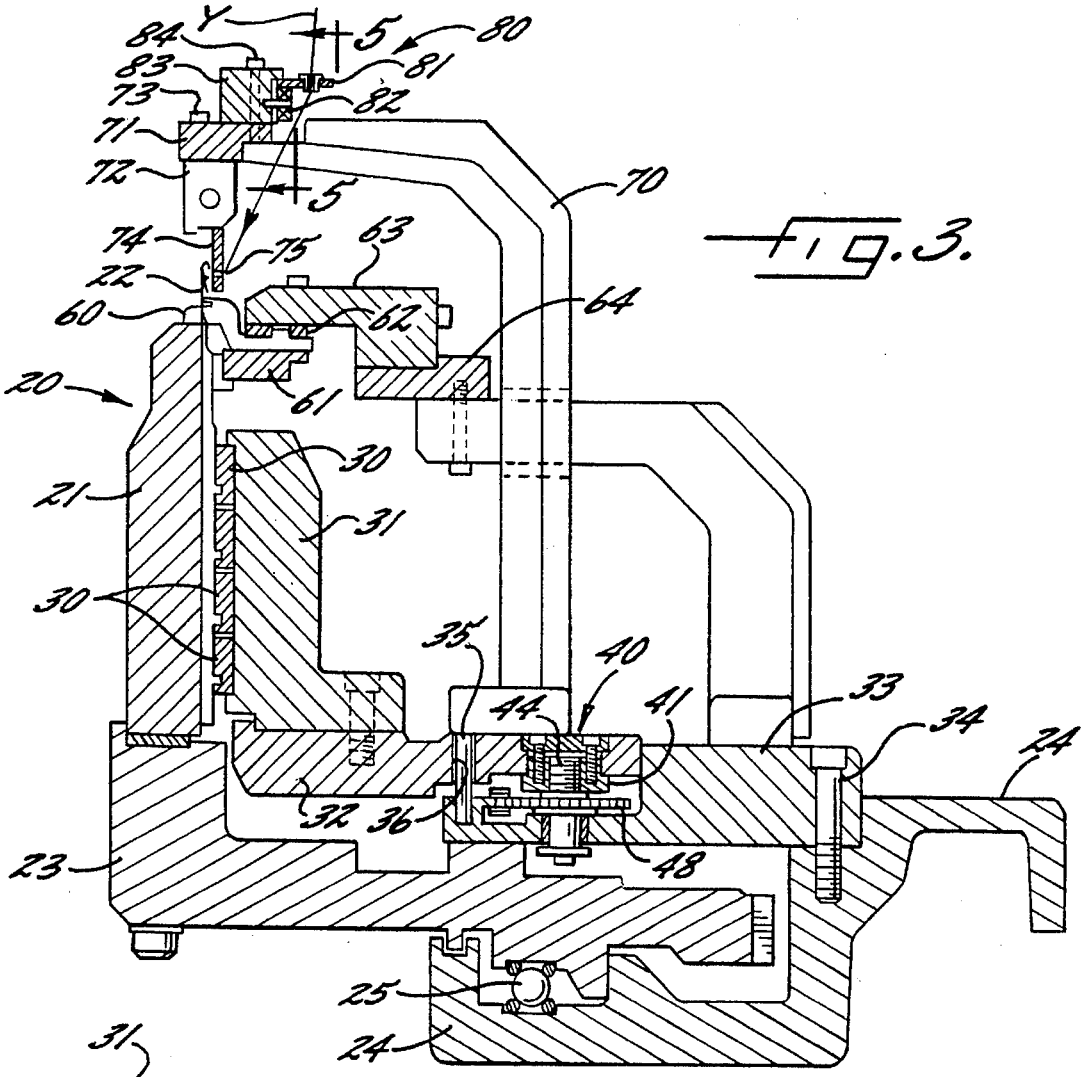
FIG. 3 is a vertical sectional view taken substantially along line 3—3 in FIG. 2.

In a single knit circular knitting machine 20, there is a needle cylinder 21 having vertical grooves in the outer periphery thereof in which are slidably mounted cylinder needles 22. Needle cylinder 21 is supported and driven in rotation by a ring gear 23 which in turn is supported on a knitting machine bed 24 by a wire race ball bearing 25 (FIG. 3). Ring gear 23 is driven by the knitting machine drive (not shown) in conventional manner.

Figure 4:
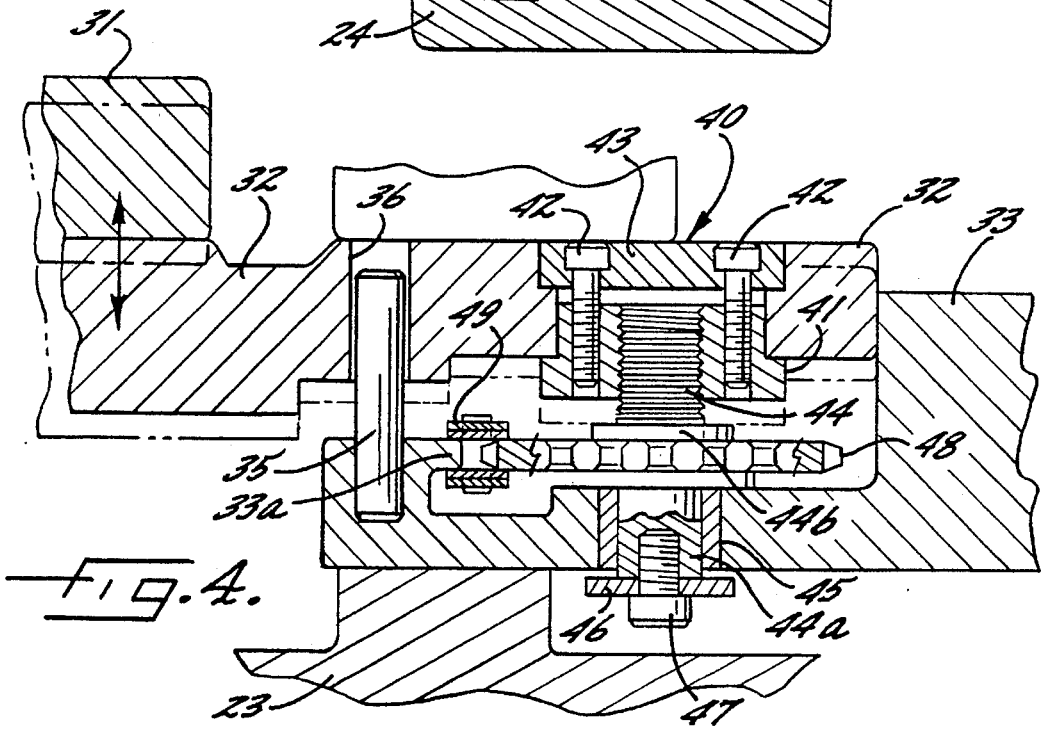
FIG. 4 is an enlarged fragmentary sectional view of the medial portion of FIG. 3.

A plurality of stitch cams 30 are supported on a cam holder support 31 for controlling the vertical sliding movement of the cylinder needles 22. Cam holder 31 surrounds the cylinder 21 (FIG. 2) and mounts the stitch cams 30 on the inner periphery thereof. A mounting plate 32, in the form of a ring, mounts the cam holder 31 for vertical adjustment on a guide ring 33. Guide ring 33 is mounted on the machine bed 24 by a plurality of bolts 34, only one of which is shown. Guide ring 33 has a plurality of upstanding guide pins 35, only one of which is shown, mounted thereon near the inner periphery thereof (FIGS. 3 and 4). Mounting plate 32 has a plurality of holes 36 therethrough which receive the upper end portions of the pins 35 therein to hold mounting plate 32 against rotation while permitting vertical movement thereof relative to the pins 35 and guide ring 33 (FIG. 4).

Figure 2:
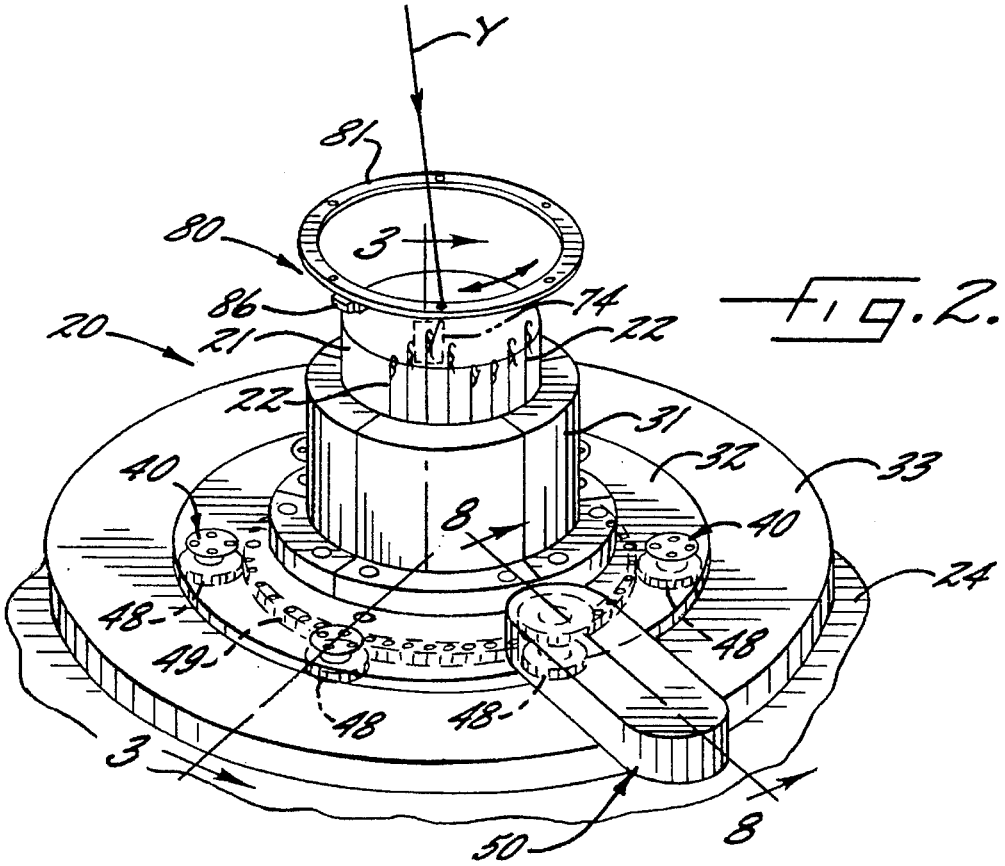
FIG. 2 is a fragmentary schematic view of the core of the knitting section of the knitting machine shown in FIG. 1.

Elevating means 40 for adjusting the vertical position of the mounting plate 32, the cam holder 31 and thus the cams 30 relative to the guide ring 33 and needle cylinder 21 is provided on mounting plate 32 and guide ring 33. The elevating means 40 preferably comprises a plurality of simultaneously driven screw jacks, approximately six (6) in number, equally spaced around the mounting plate 32 and guide ring 33 and each including an internally threaded nut 41 mounted on mounting plate 32 by bolts 42 and a clamp member 43. An externally threaded screw member 44 is rotatably mounted on the guide ring 33 by a sleeve bearing 45, a washer 46 and a bolt 47. The shank portion **44*a* of the screw 44 penetrates through the bearing 45 and has the washer 46 mounted on the lower end thereof by the bolt 47. Screw 44 has a shoulder 44*b* between the threaded portion and the shank portion 44*a* thereof. The shank portion 44*a* of the screw 44 is slightly longer than the bearing 45 to permit limited axial or vertical movement of the screw 44 relative to the guide ring 33. A sprocket 48 is mounted on each screw member 44 in driving relation thereto. The teeth of the sprocket 48 mate with the links of a sprocket chain 49 mounted for rotation on a race portion 33*a* of the guide ring 33 (FIGS. 2 and 4**).

Figure 8:
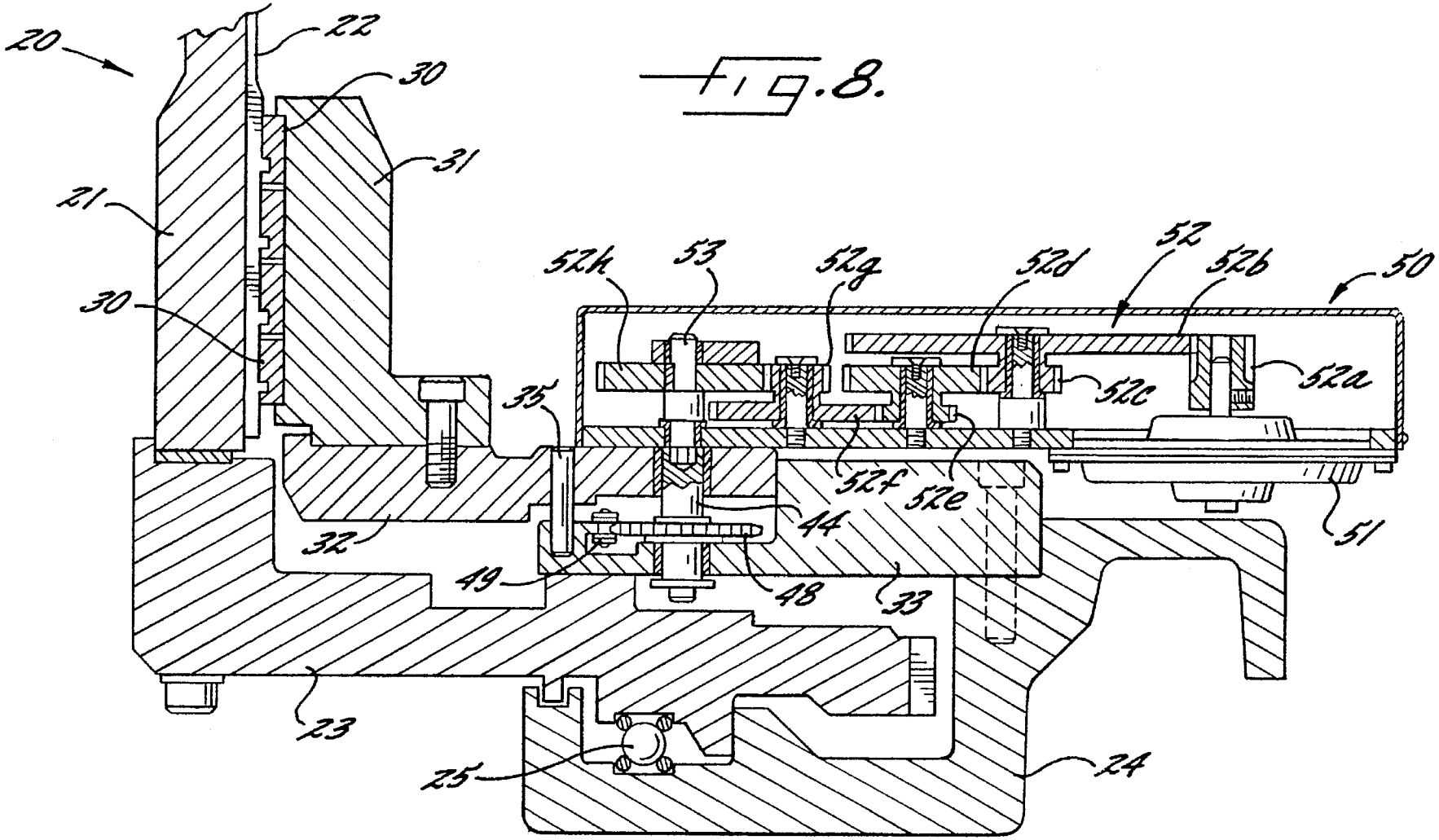
FIG. 8 is a sectional view of the lower portions of the needle cylinder, stitch cams and cam support and elevating means of a circular knitting machine in accordance with the present invention.

One of the screw members 44 has a drive means 50 operatively connected thereto (FIG. 8). Drive means 50 includes a reversible drive motor 51, which through a gear reduction unit 52, including gears **52*h*, drives a shaft 53 drivingly mounted on the upper end of the screw member 44. In this manner, drive motor 51 rotates the one screw member 44 which rotates the one sprocket 48. The one sprocket 48 rotates the sprocket chain 49 which in turn rotates the sprockets 48 of the remaining screw jacks to raise or lower the cam holder 31 and concomitantly the stitch cams 30**.

In the single knit circular knitting machine 20, sinkers 60 operate in association with the cylinder needles 22 in forming the stitches. Sinkers 60 are mounted for sliding radial movement relative to the needle cylinder 21 by a sinker dial 61. The sinkers are moved outwardly and inwardly by sinker cams 62 carried by a sinker cap 63 which in turn is supported by a cap ring 64 (FIG. 3). The cap ring 64 is mounted on a plurality of support stanchions 65 carried by guide ring 33 and equally spaced therearound.

A plurality of yarn carrier ring supports preferably from four (4) to six (6) in number, are mounted on the cam holder mounting plate 32 and extend upwardly and outwardly therefrom to free upper ends. The upper ends of the yarn carrier ring supports 70 mount a yarn carrier ring 71. Alternatively, carrier ring supports 70 may be mounted on the sinker cap ring 64 instead of the cam holder mounting plate A plurality of mounting blocks 72 are suspended from the yarn carrier ring 71 by bolts 73. A corresponding number of yarn feed fingers 74 are suspended from the mounting blocks 72 which have yarn feeding orifices 75 therein for feeding yarns Y to the needles 22. The yarns Y are fed to the yarn fingers 74 by positive yarn feed means 76 of conventional construction (FIG. 1).

Figure 5:
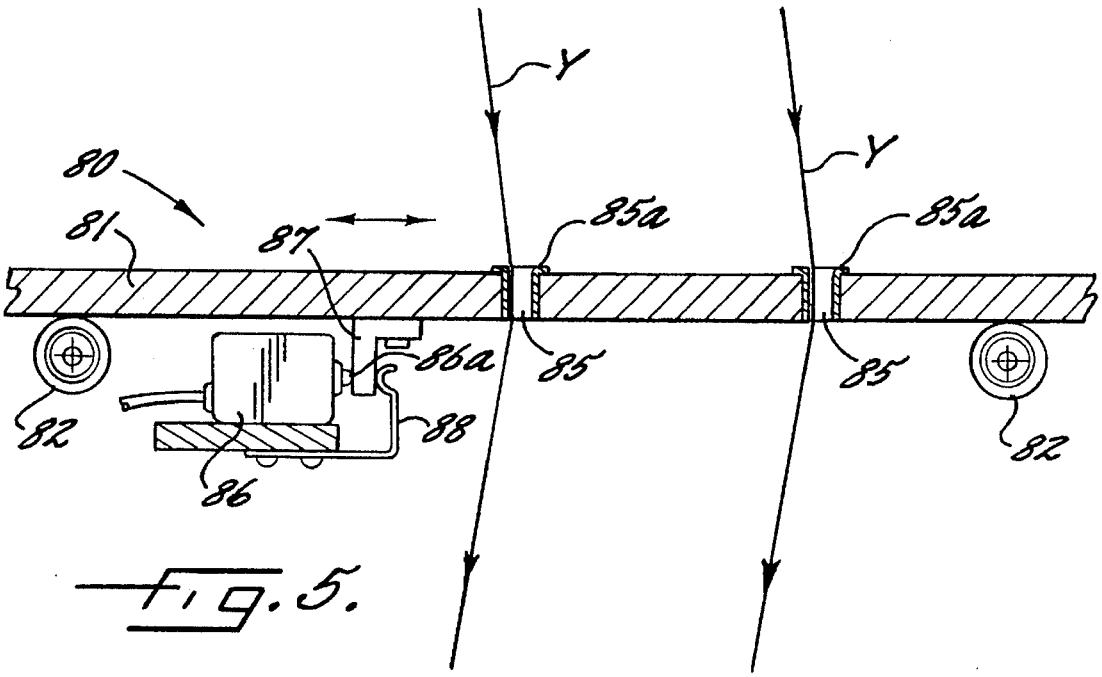
FIG. 5 is an enlarged fragmentary sectional view taken substantially along line 5—5 in FIG. 3.

Yarn tension detecting means 80 is provided between the yarn fingers 74 and the positive yarn feed means 76 (FIGS. 2 and 3). Detecting means 80 preferably includes a circular ring member 81 rotatably mounted by bearings 82 on a plurality of mounting members 83, preferably four (4) to six (6) in number. Mounting members 83 are mounted on yarn carrier ring by bolts 84. Circular ring member 81 has a plurality of yarn guide apertures or orifices 85 therein equal in number to the number of yarn fingers 74 and positive yarn feed means 76. Each aperture 85 has a yarn guide **85*a* of wear-resistant material, such as ceramic or porcelain, therein (FIG. 5**).

The yarn guides 85 in circular ring member are positioned such that the yarns Y change direction or bend as they pass through the guide apertures Accordingly, changes in the collective or average tension in the yarns Y will cause the circular ring member 81 to rotate in one or the other direction. A position detecting switch means or load cell 86 is provided beneath the circular ring member 81 for detecting changes in the position of the ring member 81. A bracket 87 is mounted on the lower side of ring member 81 in position to contact the actuator **86*a* of load cell 86. A spring 88 biases the bracket 87 and thus ring member 81 toward the actuator 86*a* of the load cell 86. The load cell 86 generates an electrical signal upon any change in the position of ring member 81 and transmits that signal to a control means 90 (FIG. 1**).

A commercially available load cell, Type TC 5R5K with a rated capacity of 5 kgf from TEAC Electronic Measuring Co., Ltd. in Kawasaki City, Japan, which is of the compressed type, can be used as the detecting load cell 86. Other types of load cells may be used and would be known to those skilled in this art.

Figure 6:
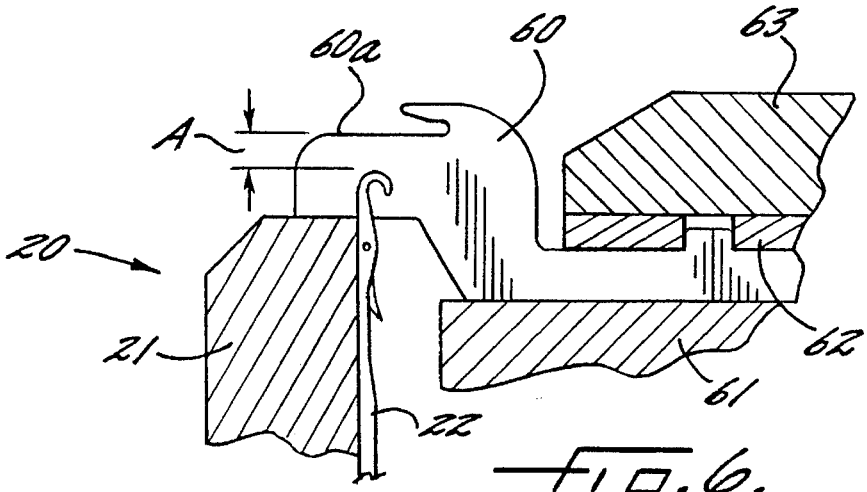
FIG. 6 is an enlarged fragmentary sectional view illustrating the spatial relationship between the needle cylinder and sinker cap in a single knit circular knitting machine.
Figure 7:
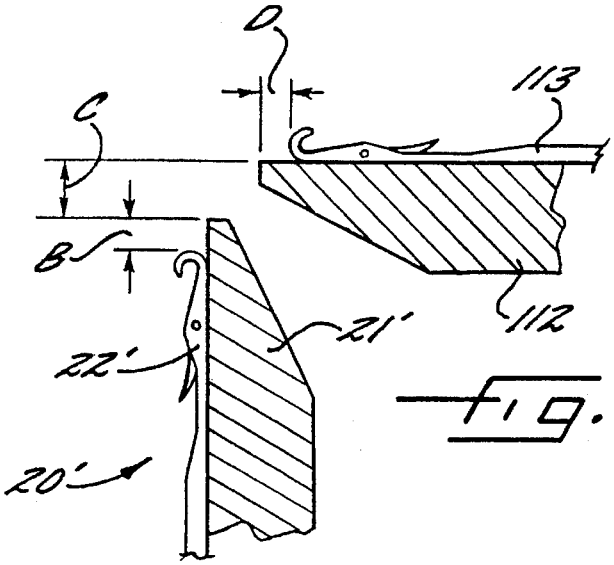
FIG. 7 is a view similar to FIG. 6 of the spatial relationship between the needle cylinder and the dial of a double knit circular knitting machine.

Alternatively to the above described tension detecting means 80, a plurality of yarn tension sensors may be used to sense the tension in the individual yarns and the outputs of two or more of those sensors averaged by an arithmetic unit and the results thereof transmitted to the control means 90. Further, a sensor that detects stitch quantity or length variation caused by thermal expansion or contraction or other positional variations in the spatial relationship of the upper end of the needle cylinder 21 to the sinkers 60 in the single knit circular knitting machine 20 (FIG. 6) or the dial of a double knit circular knitting machine 20' (FIG. 7) may be used. As shown in FIG. 6, the distance A from the top of the cylinder needle 22 to the stitch drawing top edge **60*a* of the sinker 60 determines the length of each stitch formed. That distance is subject to change by thermal expansion and contraction and by other factors. Similarly, as illustrated in FIG. 7, the distance or space B between the top of cylinder needle 22' and the top of needle cylinder 21'; the distance or space C between the top of the needle cylinder 21' and the top of dial 112; and the space D between the hook of dial needle 113 and the periphery of dial 112 all affect the stitch length in knitting machine 20'. The distance sensor (later described) generates a signal which is transmitted to control means 90**. Still further, a temperature sensor that measures temperature fluctuations in the knitting section and converts such temperature fluctuations into stitch length variations signals could be employed.

Figure 11:
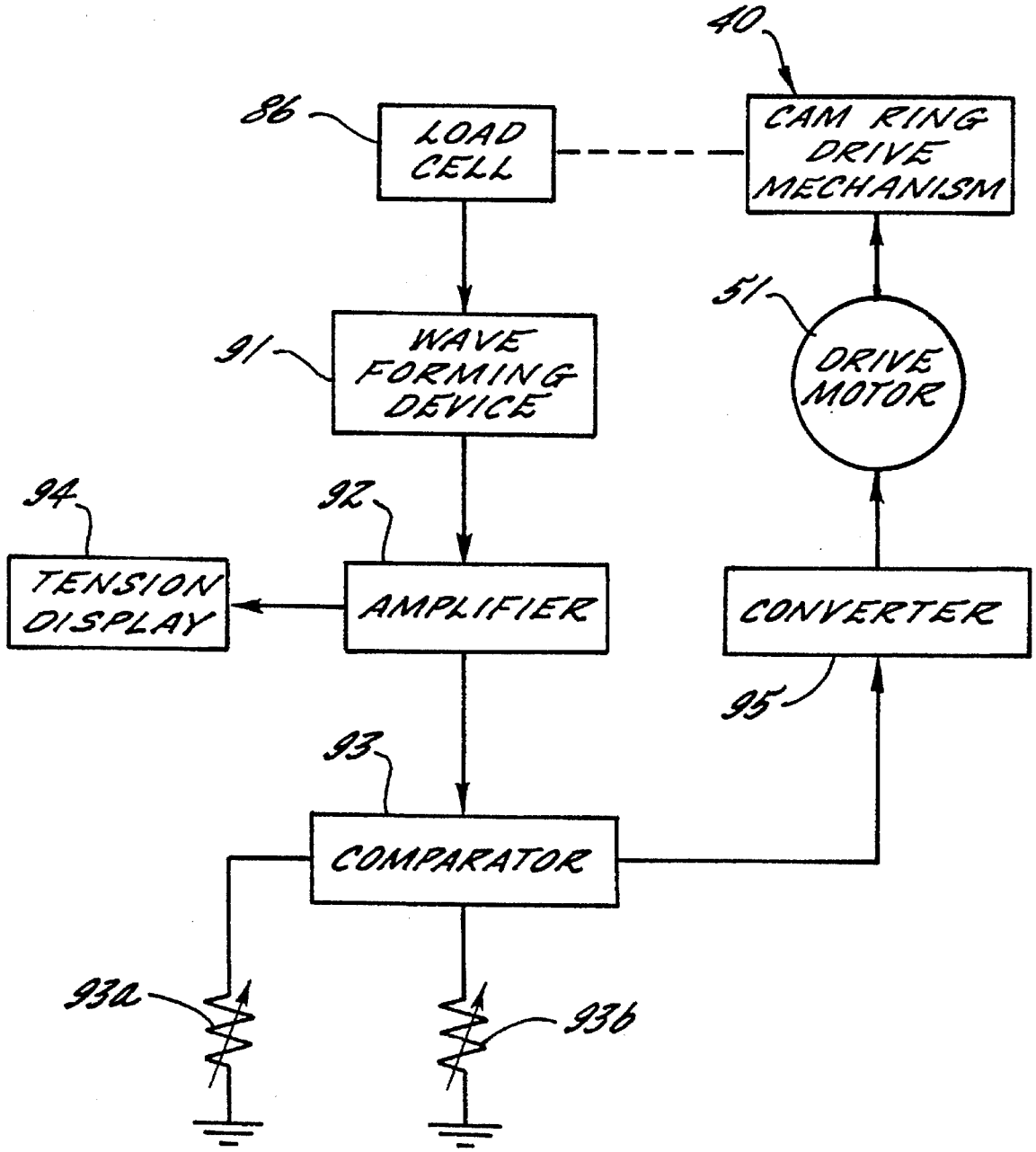
FIG. 11 is a schematic view of a control device in accordance with the present invention.

Referring to FIG. 11, the signal from load cell 86 is transmitted to a wave forming device 91 which forms a part of control means 90. The signal is converted to a wave form in the wave forming device 91, amplified in an amplifier 92 and then entered into a comparator 93. At the same time, the amplified wave form is converted into a tension indication and displayed by a tension display means 94. Comparator 93 includes a first setting means **93*a* and a second setting means 93*b*. The first setting means 93*a* pre-sets the desired knitting yarn tension, such as, for example, four grams, and the second setting means 93*b* pre-sets the permissible variation from the pre-set desired tension, such as, for example, ± one gram. The setting means 93*a* and 93*b*** are illustrated as being analog devices. It should be readily apparent, however, that digital devices could be used instead of these analog devices.

The comparator 93 compares the wave-form signal with the pre-set desired tension set by first setting means **93*a* and the permissible variation set by second setting means 93*b* and transmits the comparison results to a converter 95. If the average tension detected exceeds or falls below the pre-set value by more than the permissible variation, the converter 95 generates a drive signal to motor 51 to raise or lower the stitch cam holder 31** by an amount to compensate for the increased or decreased tension and to correct the yarn tension to the desired value.

The control means 90 will function in the same manner regardless of whether the input signal comes from a load cell, a distance sensor or a temperature sensor. The control means 90 can receive and process an input signal indicative of a change in any condition that affects stitch length.

Figure 9:
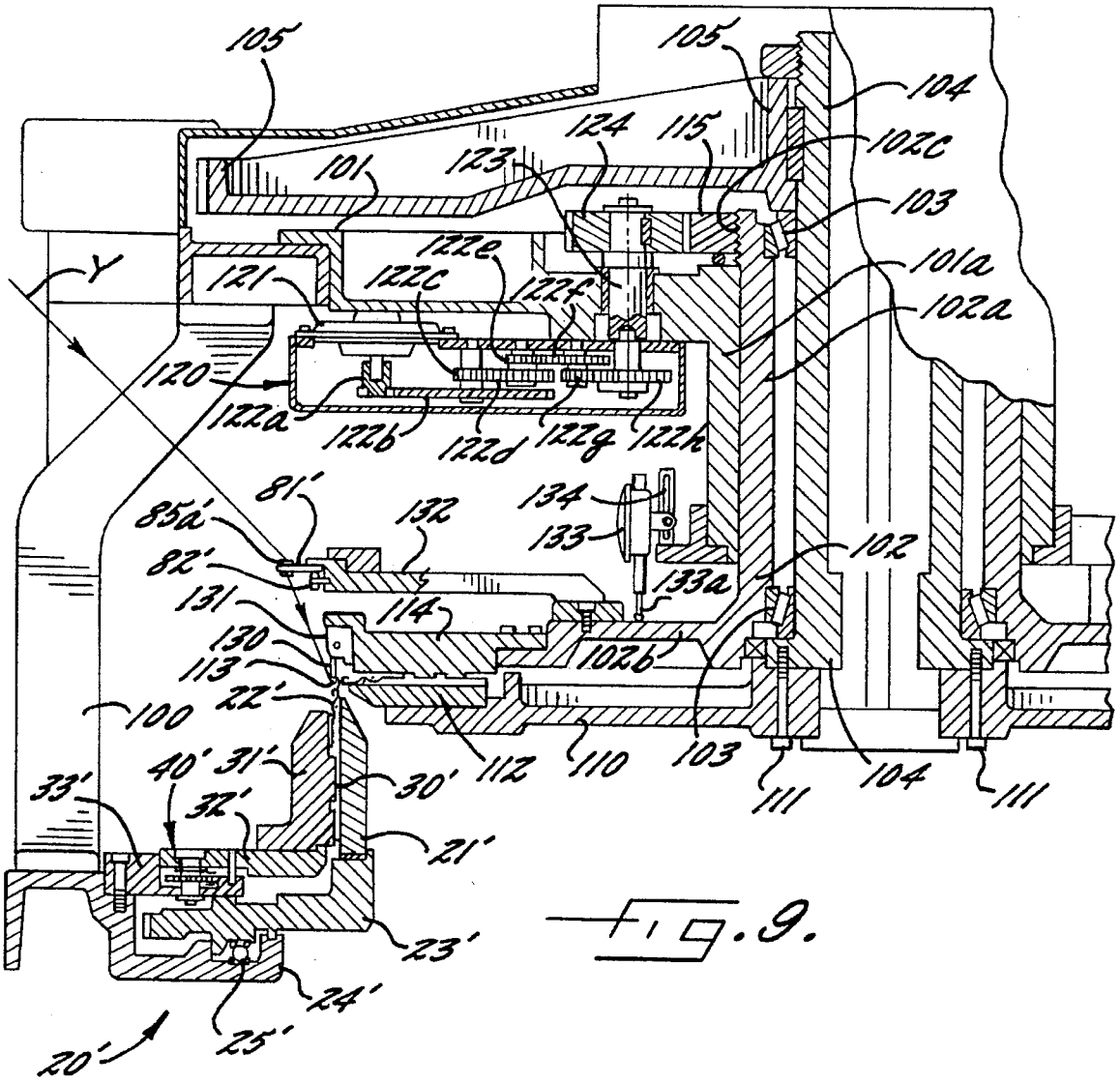
FIG. 9 is a fragmentary sectional view of the knitting section of a double knit circular knitting machine incorporating the present invention.

Referring now to FIG. 9, another embodiment of the present invention will now be described, in which like components will be referred to by the same reference characters with the prime notation added. A double knit circular knitting machine is generally indicated at 20' and includes a needle cylinder 21' having cylinder needles 22' slidably mounted in grooves in the periphery of cylinder 21'. Cylinder 21' is mounted on ring gear 23' which in turn is rotatably mounted on bed 24' by bearing 25'. Cylinder needle stitch cams 30' are supported by a cam holder 31'. Cam holder 31' is supported by a mounting plate 32' mounted for vertical adjustment on a guide plate 33' by elevating means 40'.

Suitable stanchions 100 on bed 24' support a top bed 101 above the needle cylinder 21'. Top bed 101 includes a vertical column portion **101*a* in which is mounted for vertical adjustment a dial support column 102 having a vertical, cylindrical portion 102*a* and a horizontal, circular hub portion 202*b*. Rotatively mounted in support column 102 by bearings 103 is a dial shaft 104 which is driven in rotation by a top gear 105. Top gear 105** is driven by the knitting machine drive (not shown) in conventional manner.

A dial hub 110 is fixedly mounted on the lower end of dial shaft 104 by bolts 111. A rotary dial 112 is anchored to the upper peripheral portion of the dial hub 110 and rotates therewith. Dial 112 has radial grooves in the upper surface thereof in which dial needles 113 are slidably mounted.

Dial needle stitch cams (not shown) are supported in contact with the dial needles 113 by a dial cam holder 114 which is fixed to the hub portion **102*b* of dial support column 102. The upper end portion of dial support column 102 has screw threads thereon and these threads 102*c* mate with internal threads of a female nut 115 stationarily mounted on top bed 101, but rotatable relative to top bed 101 and dial support column 102**.

A drive means 120 is provided for rotating the female nut 115 to raise and lower the dial support column 102 and thus the dial 112 and cam holder 114. Drive means 120 includes a reversible drive motor and a gear reduction unit consisting of gears **112*a*–122*h*. Gear 122*h* drives a shaft 123 on the upper end of which is a drive pinion 124 which meshes with gear teeth on the periphery of female nut 115. Accordingly, when drive means 120 rotates the female nut in one direction, the dial support column 102, dial shaft 104, dial hub 110, dial 112 and dial cam holder 114** will be raised and vice versa.

The yarns Y are fed by positive feed means (not shown) to feed fingers 130 carried by support blocks 131 mounted on the outer periphery of dial cam holder 114. The feed fingers 130 direct the yarns Y to the cylinder needles 22' and the dial needles 113. Intermediate the positive feed means (not shown) and the feed fingers 130, the yarns Y pass through yarn guides **85*a*'in a circular member 81' rotatably mounted by bearings 82' on a support member 132 which in turn is mounted on the hub portion 102*b* of the dial support column 102**.

A distance sensor 133 is mounted on the lower end of the top bed portion **101*a* shy an adjustable bracket 134. Distance sensor 133 includes an actuator 133*a* which projects downwardly into contact with the huh portion 102*b* of the dial support column 102. The distance sensor 133 remains stationary and senses variations in the vertical position of the dial support column 102 and thus the dial 112 and dial needles 113 relative to the upper end of the needle cylinder 21'. Distance sensor 133 generates a signal indicative of the effect of such distance variations on stitch length and transmits that signal to the control means 90**.

The circular member 81' and yarn guides **85*a*' cooperate with a load cell (not shown) which operates exactly like load cell 86 to detect variations in the tension in yarns Y and to transmit such signals to the control means 90**.

Figure 10:
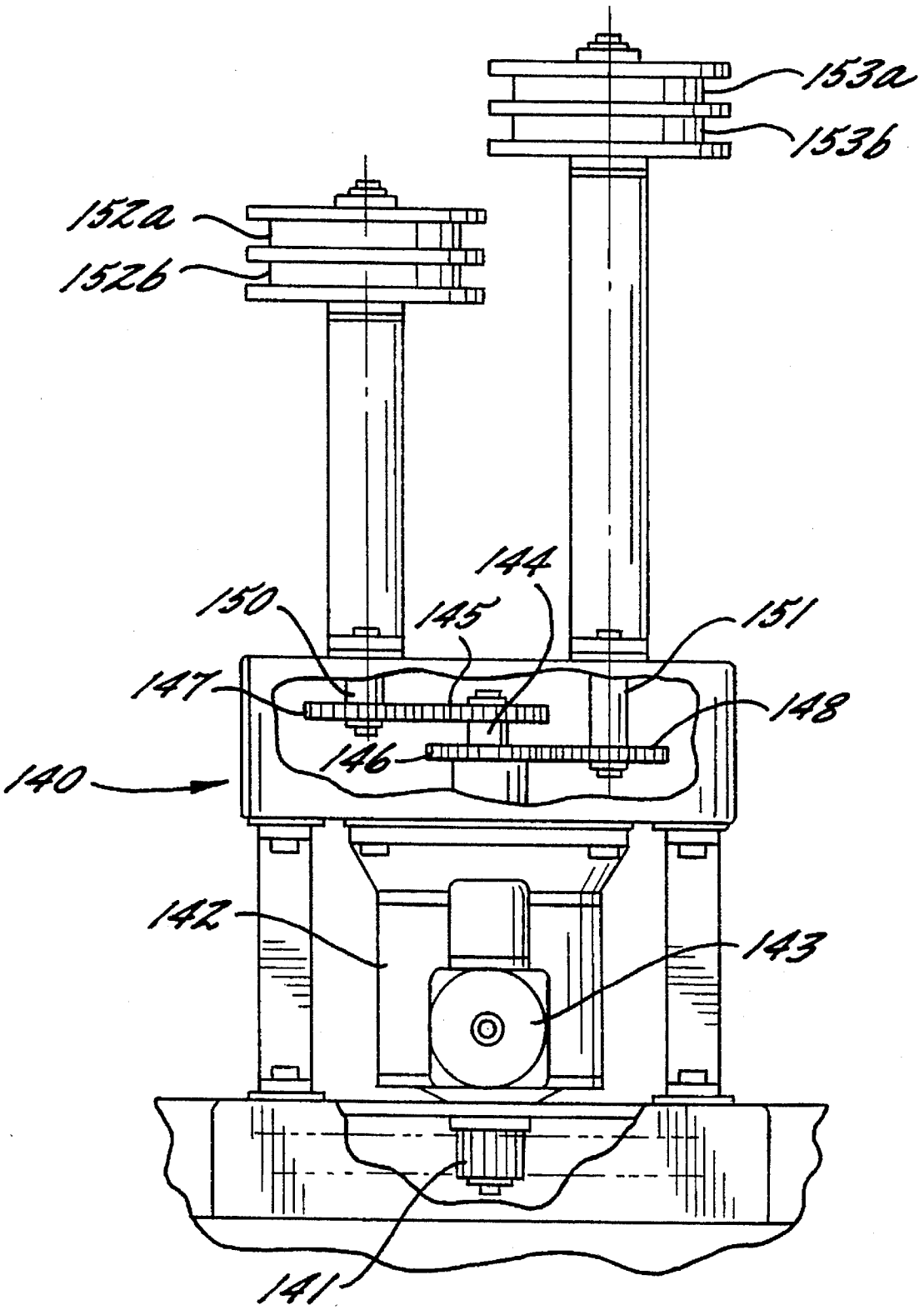
FIG. 10 is a fragmentary elevational view of the drive unit of a positive yarn feeder taken substantially along line 10—10 in FIG. 1.

Referring now to FIG. 10, there is illustrated a drive means 140 for driving the positive yarn feed means 76. Drive means 140 includes a timing pulley 141 at the lower end of an input shaft of a stepless transmission 142. Transmission 142 may he of any suitable type, such as Type RX 400 shy Simpo Industry, Kyoto, Japan, with a control system, such as Type LR 2A shy Simpo Industry, Kyoto, Japan.

Transmission 142 is shifted by a pilot motor 143 and drives an output shaft 144. Drive gears 145, 146 are fixed to output shaft 144 and mesh with gears 147, 148 mounted on a pair of shafts 150, 151. Pulleys **152*a*, 152*b* and 153*a*, 153*b* are respectively mounted on the shafts 150, 151 and are convertible in the diametrical direction. Pulleys 152*a*, 152*b*, 153*a* and 153*b* drive the positive yarn feeder 76, which may be of the MPF Type by Memminger in Germany, by means of an endless belt (not shown). In the commercially available drive mentioned above, the revolutions per minute of the output shaft 144** are not displayed, but it is preferable to do so by means of a magnetic sensor or a tachogenerator and a display means.

Further, if a desired knitting yarn feed (rotating speed of the pulley) is entered into a separately established known control device (see, for example, Japanese Patent Publication No. 17460 of 1981), it is converted to revolutions of the output shaft 144 by an arithmetic unit. Then, the difference between the converted revolutions and the detected revolutions can be compared to output the corresponding signal to pilot motor 143 in accordance with the difference. Other variations of drive means 140 will be readily apparent to persons skilled in this art.

Figure 12:
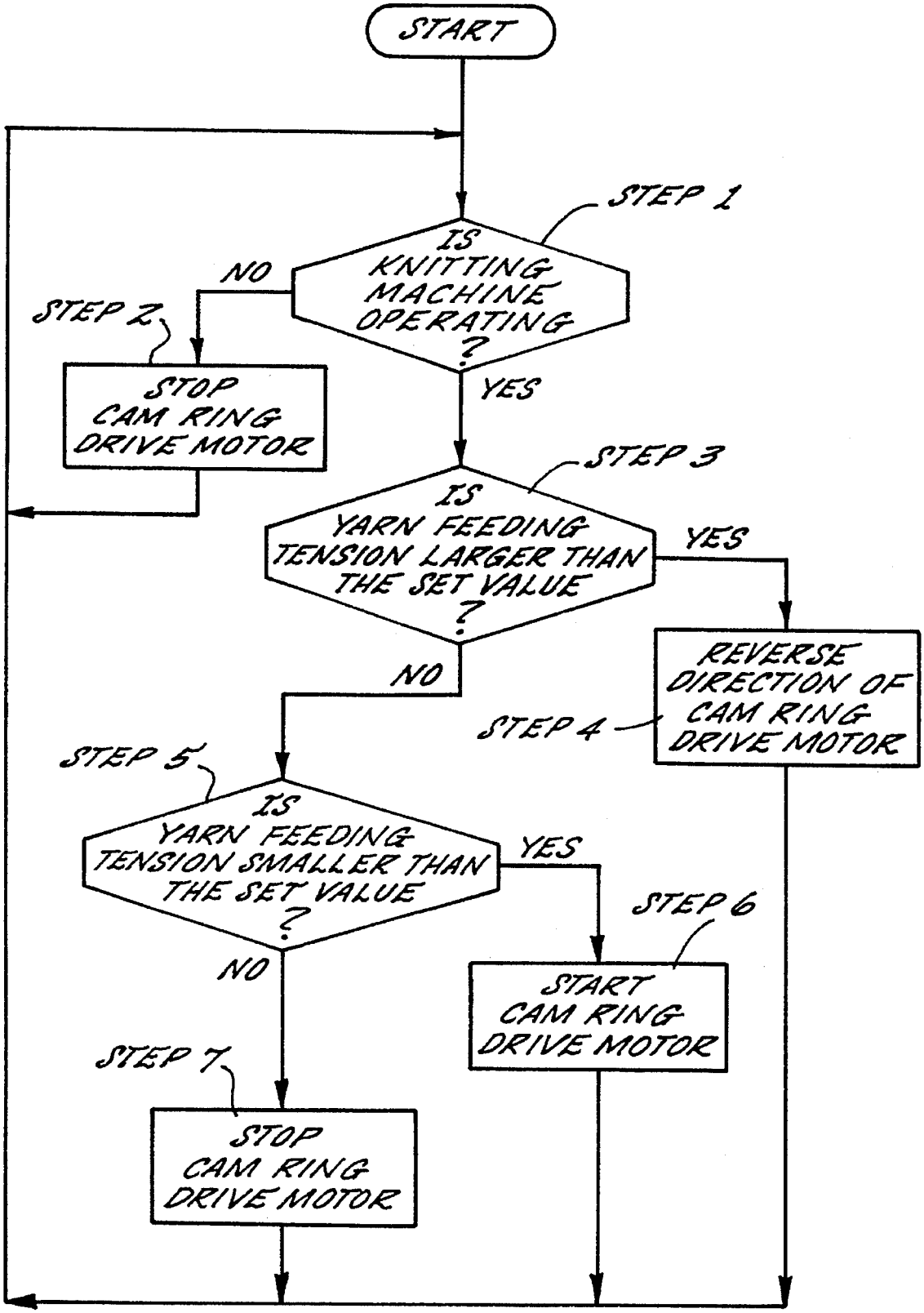
FIG. 12 is a schematic block diagram of a flow chart in the method of the present invention.

Referring now to FIG. 12, there is illustrated a flow chart of the control method in accordance with the first embodiment of the present invention. First, in step 1, the program determines whether or not the knitting machine is in operation. If the answer is "No," the program proceeds to alternate step 2 and stops the drive motor 51. If the answer is "Yes," the program proceeds to step 3 and determines whether or not the measured value of the current knitting yarn feeding tension is larger than the set value plus the allowable variation therefrom. If the answer is "Yes," the program proceeds to step 4 and reverses the direction of drive motor 51. If the answer is "No," then the program proceeds to step 5 wherein it is determined whether or not the measured value of the yarn feeding tension is less than the set value minus the allowable variation. If the answer is "Yes," the program proceeds to step 6 and starts the drive motor 51 If the answer is "No," the program proceeds to step 7 and stops the drive motor 51.

The program will operate similarly with the second embodiment of the present invention except that motor 121 will be controlled rather than motor 51. In some instances, it may be desirable to control both motor 51 and motor 121 in knitting machine 20'.

In accordance with the present invention, variations in the knitting yarn feeding tension caused by the inertia of the knitting section components, including the needle bed, and thermal expansion thereof in high speed knitting can be corrected. Therefore, high quality fabric may be produced. Moreover, by guiding a plurality of knitting yarns through a plurality of guides 85*a*, 85*a'* in the tension detecting member 81, 81', the increase or decrease in the tension of the plurality of yarns, as opposed to that of individual yarns, can be detected to obtain an average tension variation for stable stitch adjustment. For example, if the yarn feeding tension of the individual yarns is four grams and a hundred yarns is fed to the knitting needles, then a maximum of 400 grams of load should be detected by the load cell 86. If, however, the load cell detects a load of 550 grams, then the average tension is 5.5 grams and the average tension exceeds the permissible variation by 0.5 of a gram and adjustment is necessary.

Furthermore, a comparison means that senses the yarn feeding speed and detects deviations therefrom is provided. The yarn feeding speed can then be changed by a stepless transmission in accordance with the detected deviation while the knitting machine is in operation. Heretofore, such adjustments were possible only while the knitting machine was stopped.

By combining the automatic stitch adjustment and the yarn feeding speed adjustment, various knitting settings in a circular knitting machine can be smoothly and automatically changed.

In the drawings and specifications, there has been set forth a preferred embodiment of the invention, and although specific terms are employed, they are used in a generic and descriptive sense only and not for purposes of limitation.

That which is claimed is:

1. In a circular knitting machine including knitting instrumentalities including stitch forming means for forming stitches of a predetermined length to produce a knit fabric, said knitting instrumentalities including yarn feeding means for feeding at least two yarns to said stitch forming means, said stitch forming means being arranged in a predetermined spatial relationship, the length of the stitches being determined by the spatial relationship between said stitch forming means and such spatial relationship being subject to being changed in the operation of said knitting machine, the combination therewith of automatic stitch length adjustment means for adjusting the spatial relationship of said stitch forming means comprising means for detecting tension in the at least two yarns and for generating a signal indicative of the tension detected, said detecting means including a circular member mounted for rotation and having at least two yarn guides through which the at least two yarns pass, said circular member rotating in response to variations in the tension in the yarns, and means for sensing changes in position of said circular member and for generating the signal indicative of the tension in the yarns, elevating means for changing the spatial relationship between said stitch forming means, and control means connected to said detecting means for receiving the signal from said detecting means, comparing that signal to a pre-set value to determine a difference therebetween, and controlling said elevating means to change the spatial relationship of said stitch forming means and to adjust thereby the length of the stitches being formed responsive to the difference in the detecting means signal and the pre-set value whereby the length of the stitches is automatically adjusted to compensate for changes in the tension in the yarns.

2. A knitting machine according to claim 1 wherein said stitch forming means include a rotating needle cylinder having vertical grooves in the periphery thereof, a plurality of needles slidably mounted in said grooves in said needle cylinder, stitch cams for raising and lowering said needles, and stitch cam holding means for holding said stitch cams and being mounted for vertical adjustment, and wherein said elevating means vertically adjusts said cam holding means to adjust vertically said cylinder needles to adjust the length of stitches being formed thereby.

3. A knitting machine according to claim 2 wherein said knitting instrumentalities further include sinkers cooperating with said cylinder needles and wherein the distance between said needles and a stitch drawing top edge of said sinkers is adjusted by said elevating means.

4. A knitting machine according to claim 2 wherein said knitting instrumentalities further include a rotating dial positioned above said needle cylinder and having grooves in the upper surface thereof, and dial needles slidably mounted in the grooves in said dial and cooperating with said cylinder needles to form double knit fabric, and wherein said elevating means vertically adjusts said cam holder which adjusts said stitch cams to adjust said cylinder needles relative to said dial needles.

5. In a circular knitting machine including a rotating needle cylinder having vertical grooves in the periphery thereof, a plurality of cylinder needles slidably mounted in the grooves in said cylinder, a sinker cap mounted above and outwardly of said needle cylinder, a plurality of sinkers mounted on said sinker cap and cooperating with said cylinder needle to form knit stitches to produce a single knit fabric, stitch cams for moving said cylinder needles vertically in said grooves, cam holder means for holding said stitch cams in operative position relative to said needle cylinder and said needles, mounting means supporting said cam holder means for vertical adjustment, and yarn feeding means for feeding a plurality of yarns under tension to said cylinder needles, the combination therewith of stitch length adjustment means comprising means for detecting the tension in the plurality of yarns and generating a signal indicative of the tension in the yarns being fed to said needles, said detecting means including a circular member mounted for rotation and having a plurality of yarn guides through which the plurality of yarns pass, said circular member rotating in response to variations in the tension in the yarns, and said detecting means further including means for sensing changes in position of said circular member and for generating the signal indicative of the tension in the yarns, control means for receiving the signal from the detecting means and comprising a setting means for setting a desired tension for the yarns, comparison means for comparing the signal from said detecting means with the value set by said setting means and generating a comparison result, and converting means for converting the comparison result from said comparison means into a driving signal, and adjusting means connected to said cam holder mounting means for vertically adjusting said cam holder means responsive to said driving signal.

6. A knitting machine according to claim 5 wherein said control means further includes second setting means for setting a predetermined range of permissible variation from the desired tension set by said setting means.

7. A knitting machine according to claim 5 wherein said control means also includes display means for converting the signal from said detecting means into a feeding tension of the knitting yarns and displaying the same.

8. A knitting machine according to claim 5 further including yarn feeding means for positively feeding the yarns to said needles, means for detecting the yarn feeding speed and generating a signal responsive thereto, comparison means for comparing the yarn feeding speed signal with a desired yarn feeding speed, stepless transmission means for changing the yarn feeding speed settings according to the comparison result of said comparison means, and means for transmitting the changed yarn feeding speed settings to said positive yarn feed means.

9. In a double knit circular knitting machine including a rotating cylinder having vertical grooves in the periphery thereof and an upper end, a plurality of cylinder needles slidably mounted in the grooves in said cylinder, a rotating dial having radial grooves in the upper surface thereof and an outer periphery, a plurality of dial needles slidably mounted in the grooves in said dial, dial mounting means for mounting said dial above the upper end of said cylinder at a distance therefrom and for vertical adjustment relative thereto to vary the distance therebetween, the combination therewith of stitch length adjustment means comprising means for detecting the distance between the upper end of said cylinder and the periphery of said dial and for generating a signal indicative of the distance detected, control means for receiving the signal from said detecting means and comprising setting means for setting a desired distance between said cylinder and said dial, comparison means for comparing the signal from said detecting means with the desired distance and generating a comparison result, and converting means for converting the comparison result from said comparison means into a driving signal, and adjusting means for vertically adjusting said dial relative to said cylinder responsive to the driving signal from said control means.

10. A double knit circular knitting machine according to claim 9 wherein said detecting means is a position sensor sensing the position of said dial mounting means.

11. A knitting machine according to claim 9 wherein said control means includes second setting means for setting a permissible range of variations in the distance between said cylinder and said dial.

12. In a double knit circular knitting machine including a rotating cylinder having vertical grooves in the periphery thereof and an upper end, a plurality of cylinder needles slidably mounted in the grooves in said cylinder, a rotating dial having radial grooves in the upper surface thereof, a plurality of dial needles slidably mounted in the grooves in said dial, dial mounting means for mounting said dial above the upper end of said cylinder at a distance therefrom and for vertical adjustment relative thereto to vary the distance between, the combination therewith of stitch length adjustment means comprising means for detecting the tension in the plurality of yarns being fed to said needles and for determining an average tension therein and generating a signal indicative thereof, control means for receiving the signal from said detecting means and comprising setting means for setting a desired tension for the knitting yarns, comparison means for comparing the signal from said detecting means with the desired value set by said setting means, and generating a comparison result, and converting means for converting the comparison result from said comparison means into a driving signal, and adjusting means for adjusting the vertical position of said dial relative to said cylinder responsive to the driving signal from said control means.

13. A knitting machine according to claim 12 wherein said control means further includes second setting means for setting a predetermined range of permissible variation from the desired tension set by said setting means.

14. A knitting machine according to claim 12 wherein said control means also includes display means for converting the signal from said detecting means into a feeding tension of the knitting yarns and displays the same.

15. A knitting machine according to claim 12 further including yarn feeding means for positively feeding the yarns to said needles, means for detecting yarn feeding speed and generating a signal responsive thereto, comparison means for comparing the yarn feeding speed signal with a desired yarn feeding speed, stepless transmission means for changing the yarn feeding speed settings according to the comparison result of said comparison means, and means for transmitting the changed yarn feeding speed settings to said positive yarn feed means.

16. A knitting machine according to claim 12 wherein said tension detecting means includes a circular member mounted for rotation and having at least two yarn guides therein through which the at least two yarns pass, said circular member rotating in response to variations in the tension in the yarns, and means for sensing changes in position of said circular member upon variations in the tension in the yarns and for generating a signal indicative of the tension in the yarns and for transmitting that signal to said control means.

17. A method of producing a knit fabric on a circular knitting machine having a rotating needle cylinder, knitting needles slidably mounted on said cylinder for vertical movement relative to other stitch forming elements which cooperate with the cylinder needles in forming knit stitches of a length, and yarn feed means for feeding a plurality of yarns under tension to the needles, said method comprising the steps of detecting the tension in the plurality of yarns being fed to the needles by a circular member rotatable in response to variations in the tension in the yarns and generating a signal of a value indicative of the tension in the yarns responsive to changes in position of the circular member, comparing the value of the signal indicative of the detected tension with a pre-set desired value of tension for those yarns and generating a comparison result, converting the comparison result into an adjustment value, and adjusting the vertical position of the cylinder needles relative to the other stitch forming elements to adjust the length of the stitches being formed to produce knit fabric having more uniform stitches therein.

18. A method according to claim 17 wherein the other stitch forming elements are sinkers having a stitch drawing top edge and wherein the cylinder needles are adjusted relative to the stitch drawing top edge of the sinkers.

19. A method according to claim 17 wherein the other stitch forming elements are dial needles and wherein the cylinder needles are adjusted relative to the dial needles.

20. A method of producing a double knit fabric of uniform stitches of a predetermined length on a circular knitting machine having a rotating needle cylinder having an upper end, cylinder needles slidably mounted on said cylinder for vertical movement, a rotating dial mounted at a distance above the needle cylinder and having an outer periphery, dial needles slidably mounted on the dial for horizontal movement, and yarn feed means for feeding a plurality of yarns under tension to the cylinder and dial needles, said method comprising the steps of detecting the distance between the upper end of the needle cylinder and the periphery of the dial and generating a signal indicative thereof, comparing the signal indicative of the detected distance with a pre-set desired distance and generating a comparison result, converting the comparison result into an adjustment value, and adjusting vertically the dial relative to the needle cylinder to adjust the length of the stitches being formed to produce a double knit fabric having more uniform stitches therein.

* * * * *

UNITED STATES PATENT AND TRADEMARK OFFICE
CERTIFICATE OF CORRECTION

PATENT NO. : 5,511,392

DATED : April 30, 1996

INVENTOR(S) : Sawazaki et al.

It is certified that error appears in the above-identified patent and that said Letters Patent is hereby corrected as shown below:

TITLE PAGE

[56] U.S. PATENT DOCUMENTS, line 5, "Tsuchiya et al." should be --Tsuchiya--.

FOREIGN PATENT DOCUMENTS, line 7, "8/1984" should be --3/1984--.

Column 1, line 37, after "knitting" insert --machine--.

Column 3, line 54, "52h" should be --52a-h--.

Column 3, line 66, after "sinkers" insert --60--.

Column 4, line 4, after "supports" insert --70,--.

Column 4, line 11, after "plate" insert --32.--.

Column 4, line 25, after "ring" insert --71--.

Column 4, line 31, after "member" insert --81--.

Column 4, line 33, after "apertures" insert --85--.

Column 5, line 62, "202b" should be --102b--.

Column 6, line 8, after "threads" insert --102c--.

Column 6, line 15, after "motor" insert --121--.

Column 6, line 16, "112a" should be --122a--.

Column 6, line 29, insert space after "85a'".

UNITED STATES PATENT AND TRADEMARK OFFICE

CERTIFICATE OF CORRECTION

PATENT NO. : 5,511,392

DATED : April 30, 1996

INVENTOR(S) : Sawazaki et al.

It is certified that error appears in the above-indentified patent and that said Letters Patent is hereby corrected as shown below:

Column 6, line 34, "shy" should be --by--.

Column 6, line 36, "huh" should be --hub--.

Column 6, line 53, "he" should be --be--.

Column 6, line 54, "shy" should be --by--.

Column 6, line 55, "shy" should be --by--.

Column 7, line 9, after "output" insert --of--.

Column 7, line 28, after "51" insert --.--.

Column 7, line 66, "specifications" should be --specification--.

Column 10, line 26, "between" should be --therebetween--.

Signed and Sealed this

Third Day of September, 1996

*Attest:*

*Attesting Officer*

BRUCE LEHMAN

*Commissioner of Patents and Trademarks*